US005163234A

United States Patent [19]

Tsukamoto et al.

[11] Patent Number: 5,163,234

[45] Date of Patent: Nov. 17, 1992

[54] HAND DRIER CONTROL APPARATUS

[75] Inventors: Ryohei Tsukamoto, Tokoname; Tadanobu Hosaka, Kariya; Akio Nara, Kariya; Takashi Kojima, Kariya; Hidetaka Hayashi, Kariya, all of Japan

[73] Assignee: Inax Corporation, Aichi, Japan

[21] Appl. No.: 566,467

[22] PCT Filed: Mar. 13, 1990

[86] PCT No.: PCT/JP90/00319

§ 371 Date: Oct. 3, 1990

§ 102(e) Date: Oct. 3, 1990

[87] PCT Pub. No.: WO90/10831

PCT Pub. Date: Sep. 20, 1990

[30] Foreign Application Priority Data

Mar. 15, 1989 [JP] Japan ..... 1-64867

[51] Int. Cl.[5] ..... F26B 19/00

[52] U.S. Cl. ..... 34/44; 34/48; 34/54; 34/55; 34/202; 392/380; 392/381

[58] Field of Search ..... 34/201, 202, 44, 48, 34/54, 55; 392/370, 360, 363, 371, 379, 380, 381; 219/518, 519

[56] References Cited

U.S. PATENT DOCUMENTS

| | | | |
|---|---|---|---|
| 2,606,274 | 8/1952 | Spierer | 392/381 |
| 3,603,002 | 9/1971 | Spierer | 392/381 |
| 3,643,346 | 2/1972 | Lester | 392/363 |
| 4,087,925 | 5/1978 | Bienek | 34/60 |
| 4,876,435 | 10/1989 | Hawkins | 392/363 |
| 5,031,337 | 7/1991 | Pilolla et al. | 34/202 |

*Primary Examiner*—Henry A. Bennet
*Assistant Examiner*—Denise L. F. Gromada
*Attorney, Agent, or Firm*—Kanesaka and Takeuchi

[57] ABSTRACT

The present invention is a warm-air machine control apparatus which is capable of blowing warm air from the beginning of the delivery of air without preheating an electric heater, and which comprises an electric fan (4), an electric heater (5) which heats air sent from the electric fan (4), a detector (7) which detects a first object to be detected within a first detecting range (a, c) and which also detects a second object to be detected within a second detecting range (b, d), and a control circuit which energizes the electric heater (5) when the detector (7) detects the first object of detection within the first detecting range (a, c), and which energizes the electric fan (4) when the detector (7) detects the second object of detection within the second detecting range (b, d).

2 Claims, 7 Drawing Sheets

HAND DRIER CONTROL APPARATUS

DESCRIPTION

1. Technical Field

The present invention relates to a warm-air machine control apparatus which is suitably used as an apparatus for controlling warm-air drying machines, for example, hand driers, hair driers, etc., and warm-air heating machines, for example, foot heaters, which are used in kitchens or toilets, and electric heating appliances. More particularly, the present invention relates to a warm-air machine control apparatus which is arranged such that an electric fan is energized after an electric heater has been energized.

2. Background Art

A typical conventional apparatus for controlling a hand drier used to blow warm air over the user's hand has heretofore been arranged such that both an electric heater and an electric motor for an electric fan are energized at the same time as the user's hand is detected by means of a non-contact switch, for example, an ultrasonic sensor, pyroelectric sensor, photoelectric sensor, etc.

In such an apparatus, a current of air is produced before the electric heater heats up sufficiently because the supply of power to the electric heater and the electric motor is started at the same time as the user's hand is detected by the sensor section. Accordingly, cold air is first blown against the user's hand, and this displeases the user.

To solve the above-described problem, an apparatus has heretofore been proposed, wherein an electric heater is constantly energized, while an electric motor is energized at the same time as the user's hand is detected, thereby enabling warm air to be blown immediately.

However, the apparatus which adopts the electric heater preheating control for constantly energizing consumes excessive electric power, and since the electric heater is in a heating condition at all times, it may adversely affect other parts.

Further, an apparatus 100 which has a delay circuit such as that shown in FIG. 7 has been proposed.

In the apparatus 100, when the power supply is turned on by actuating a main switch (not shown), an electric signal is sent from an oscillator circuit 101 to a sensor section 102. When the user's hand is detected by the sensor section 102, a current signal is sent from the sensor section 102 to a current-to-voltage converter circuit 103. This current signal is converted into a voltage signal in the current-to-voltage converter circuit 103 and subsequently amplified in an amplifier circuit 104. The amplified voltage is sent to a comparator circuit 105 where it is compared with a preset reference voltage. If, at this time, the amplified voltage is higher than the reference voltage, the comparator 105 sends an "on" signal to a first timer circuit 106.

The first timer circuit 106 turns on a transistor 107 for a predetermined time (from 1 to 3 seconds) and sends an "on" signal to an AND circuit 108. In response to the turning on of the transistor 107, an electric heater 109 is electrically connected to the power supply. The transistor 107 that is turned on also sends an "on" signal to a delay circuit 110. The delay circuit 110 sends an "on" signal to the AND circuit 108 with a delay time (from 5 to 10 seconds) with respect to the "on" signal sent thereto. When receiving "on" signals from both the first timer circuit 106 and the delay circuit 110, the AND circuit 108 sends an "on" signal to a second timer circuit 111. The second timer circuit 111 turns on a transistor 112 for a predetermined time (from 1 to 3 seconds). In response to the turning on of the transistor 112, a triac (not shown) is turned on to electrically connect an electric fan 113 to the power supply. Thus, warm air is blown over the user's hand.

In this apparatus 100, the starting of the electric fan is delayed with respect to the starting of the electric heater by the delay time by the operation of the delay circuit 110. The object of hand driers is to dry the user's hands quickly by blowing warm air over them. Accordingly, the latter apparatus, which is incapable of immediately blowing warm air over the user's hands, suffers from the problem of great inconvenience.

DISCLOSURE OF INVENTION

It is an object of the present invention to provide a warm-air machine control apparatus which is capable of blowing warm air immediately and from the beginning without the need to adopt the electric heater preheating control.

The present invention provides a warm-air machine control apparatus comprising: an electric fan which produces a current of air flowing toward the user's body when energized; an electric heater which heats, when energized, the air flowing toward the user's body that is produced by the electric fan; a non-contact detecting means which detects a first object to be detected within a first detecting range and which also detects a second object to be detected within a second detecting range; and a control circuit which energizes the electric heater when the detecting means detects the first object of detection within the first detecting range, and which energizes the electric fan when the detecting means detects the second object detection within the second detecting range.

With the above-described arrangement, the warm-air machine control apparatus of the present invention has the following function:

At the same time as the non-contact detecting means detects the first object of detection within the first detecting range, the control circuit energizes the electric heater. Subsequently, at the same time as the non-contact detecting means detects the second object of detection within the second detecting range, the control circuit energizes the electric fan. Thus, immediately and from the beginning, sufficiently heated air is blown over the user's body by means of the electric heater.

BEST MODE FOR CARRYING OUT THE INVENTION

Embodiments of the warm-air machine control apparatus according to the present invention will be described on the basis of FIGS. 1 to 6.

Figure 1:
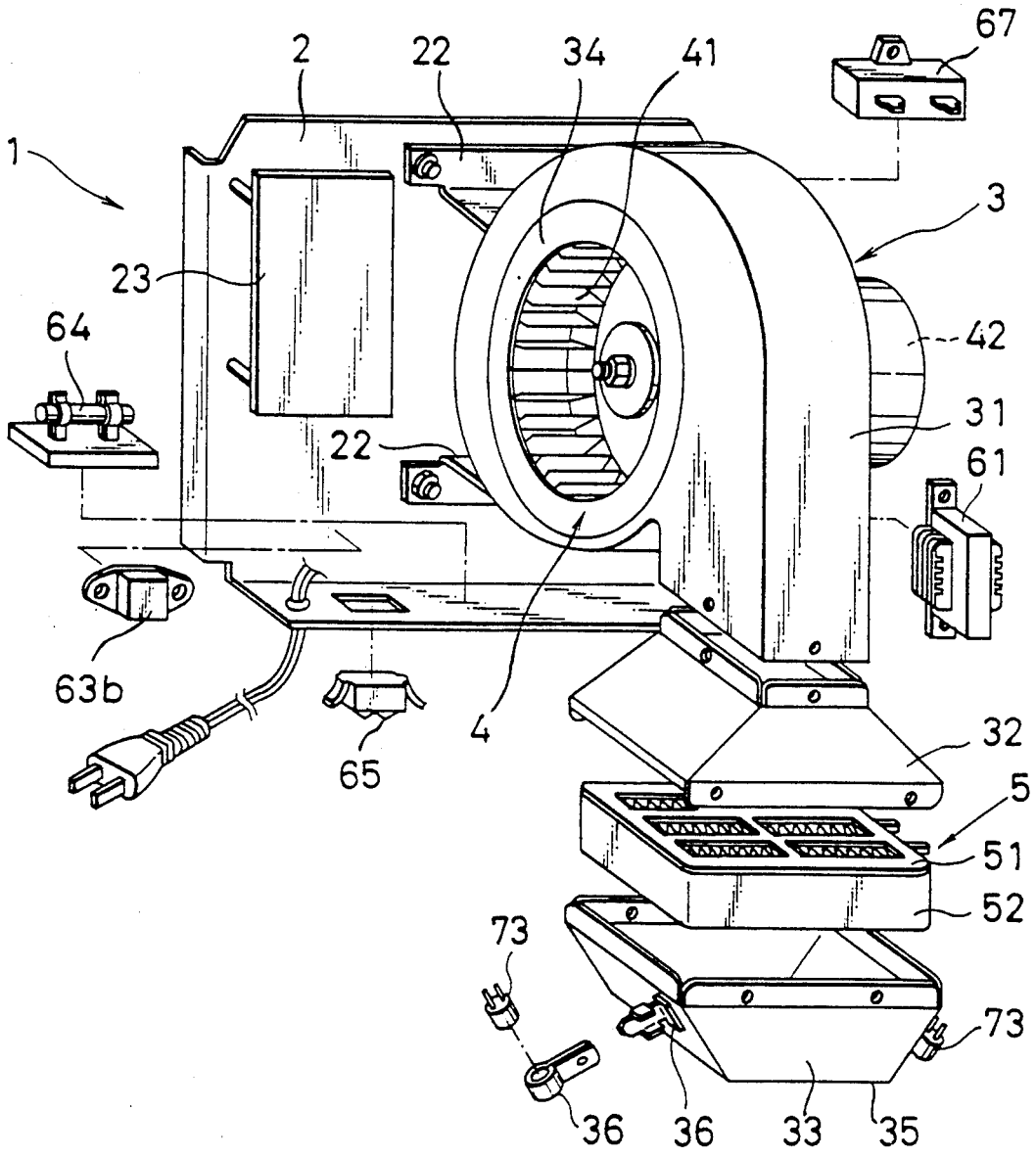
FIG. 1 is a schematic view showing a hand drier control apparatus that adopts a first embodiment of the present invention.

FIG. 1 shows a hand drier control apparatus that adopts one embodiment of the present invention.

Reference numeral 1 denotes a hand drier control apparatus that adopts the warm-air machine control apparatus according to the present invention.

The hand drier control apparatus 1 is disposed, for example, on a wall surface of a washroom, and comprised of a ventilating duct 3 which is rigidly secured to a mounting plate 2, an electric fan 4 and a PTC heater 5 serving as an electric heater, which are accommodated in the ventilating duct 3, and a control circuit 6 which controls the energization of the electric fan 4 and the PTC heater 5.

The mounting plate 2 is rigidly secured to the inner wall of a housing (shown in FIG. 3) 21 for accommodating and retaining the ventilating duct 3 and the control circuit 6. Brackets 22 for securing the ventilating duct 3 are fastened to the mounting plate 2, and a retaining plate 23 for retaining the control circuit 6 is also secured to the mounting plate 2.

The ventilating duct 3 is adaped to send air toward the user's hand and comprised of a scroll casing 31, an upper duct 32 and a lower duct 33. The scroll casing 31, which is adapted to accommodate the electric fan 4, is attached to the mounting plate 2 through the brackets 22 and provided in one side surface thereof with a suction port 34 for sucking air into the inside. The upper duct 32 is connected to a delivery side of the scroll casing 31 to lead the air sucked in through the suction port 34 in the scroll casing 31 to the PTC heater 5. The lower duct 33 is connected to the delivery side of the upper duct 32 and provided with an air outlet 35 for blowing air over the user's hand. In this embodiment, the air outlet 35 opens downward. In addition, mounting members 36 for mounting detecting means are rigidly secured to the left and right side walls of the lower duct 33.

The electric fan 4 comprises a fan member 41 and an electric motor 42. The fan member 41 produces a current of air flowing toward the user's hand within the ventilating duct 3. The electric motor 42, when energized (hereinafter referred to as "turned on"), activates the fan member 41 to rotate at a predetermined speed. When the energy is cut off (hereinafter referred to as "turned off"), the motor 42 suspends the drive of the fan member 41. The electric motor 4 and the scroll casing 31 constitute in combination a centrifugal blower.

The PTC heater 5 is incorporated in between the upper and lower ducts 32 and 33, and when turned on, it heats up quickly to a set temperature to heat the air passing through the ventilating duct 3. The PCT heater 5 is a positive temperature coefficient thermistor which comprises radiating fins and other elements. The PTC heater 5 is clamped at the upper and lower ends by insulating plates 51 with windows and held at the periphery thereof by a holder 52 which is in the form of a frame having a rectangular cross-section, the holder 52 being secured to either the upper duct 32 or the lower duct 33.

Figure 2:
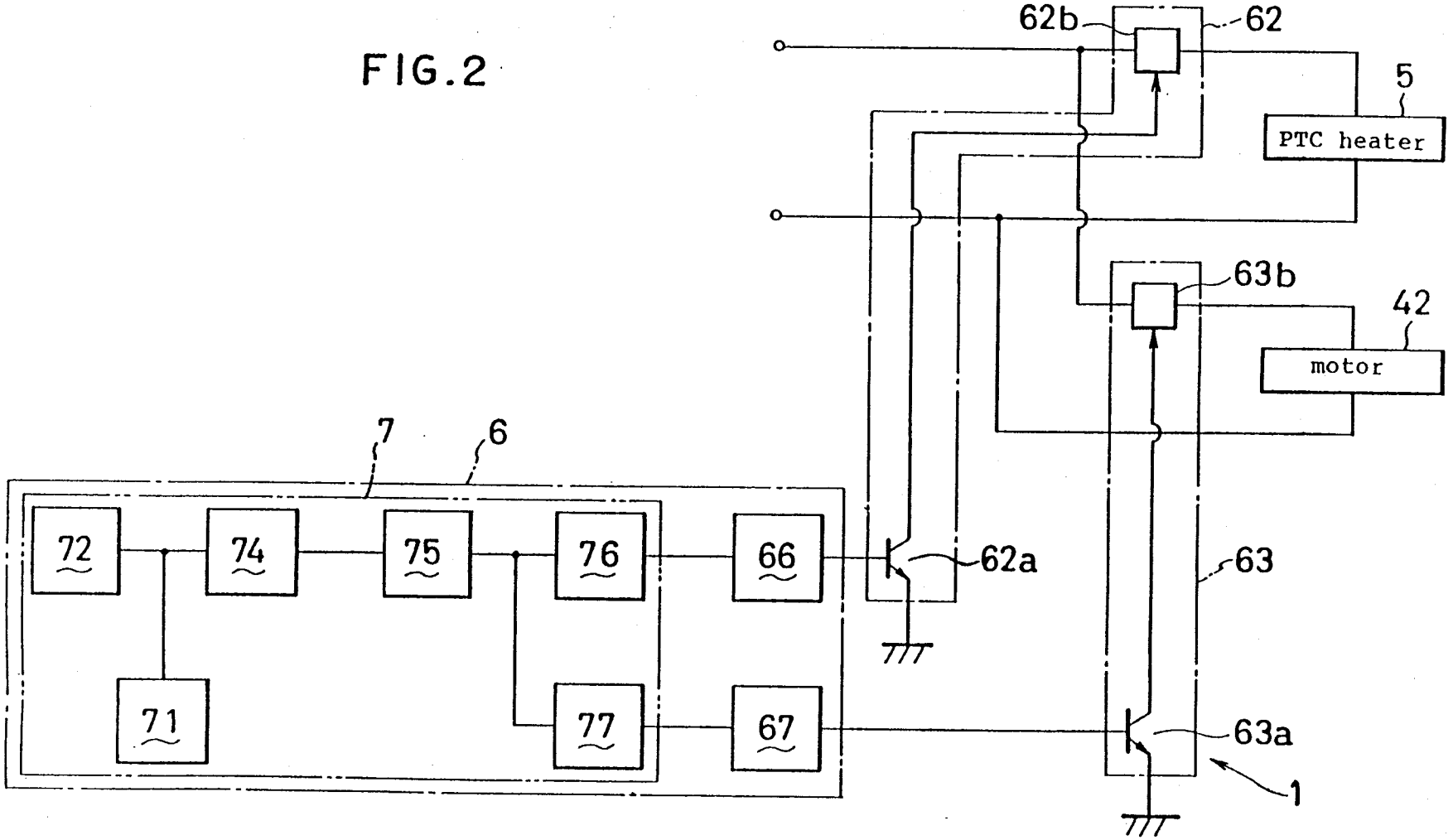
FIG. 2 is a circuit diagram of a control circuit in the control apparatus.

FIG. 2 is a circuit diagram of the control circuit 6 in the hand drier control apparatus 1.

An essential part of the control circuit 6 is retained on the retaining plate 23 that is secured to the mounting plate 2. The control circuit 6 is connected to a commercial power supply through a transformer 61. The transformer 61 lowers and rectifies AC 100V to supply the control circuit 6 with a driving current of DC 12V.

The control circuit 6 is further connected to the PTC heater 5 through a heater switching circuit 62 and to the motor 42 of the electric fan 4 through a fan switching circuit 63.

The heater switching circuit 62 has a heater transistor **62*a* and a heater triac 62*b*. When the base of the heater transistor 62*a* is turned on, the emitter and collector thereof conduct to each other, so that the heater triac 62*b* is energized. When turned on, the heater triac 62*b* electrically connects together the PTC heater 5 and the commercial power supply through a fuse 64 and a main switch 65**.

The fan switching circuit 63 has a fan transistor **63*a* and a fan triac 63*b*. When the base of the fan transistor 63*a* is turned on, the emitter and collector thereof conduct to each other, so that the fan triac 63*b* is also energized. When turned on, the fan triac 63*b* electrically connects together the motor 42 of the electric fan 4 and the commercial power supply through the fuse 64 and the main switch 65**.

The control circuit 6 further has a detector 7, a first timer circuit 66 and a second timer circuit 67.

The detector 7 comprises an oscillator circuit 71, a sensor section 72, a current-to-voltage converter circuit 74, an amplifier circuit 75, a first comparator circuit 76 and a second comparator circuit 77.

The oscillator circuit 71 sends an electric signal of 40.5 kHz to the sensor section 72 as long as the main switch 65 is on and the oscillator circuit 71 is in connection with the commercial power supply.

Figure 3:
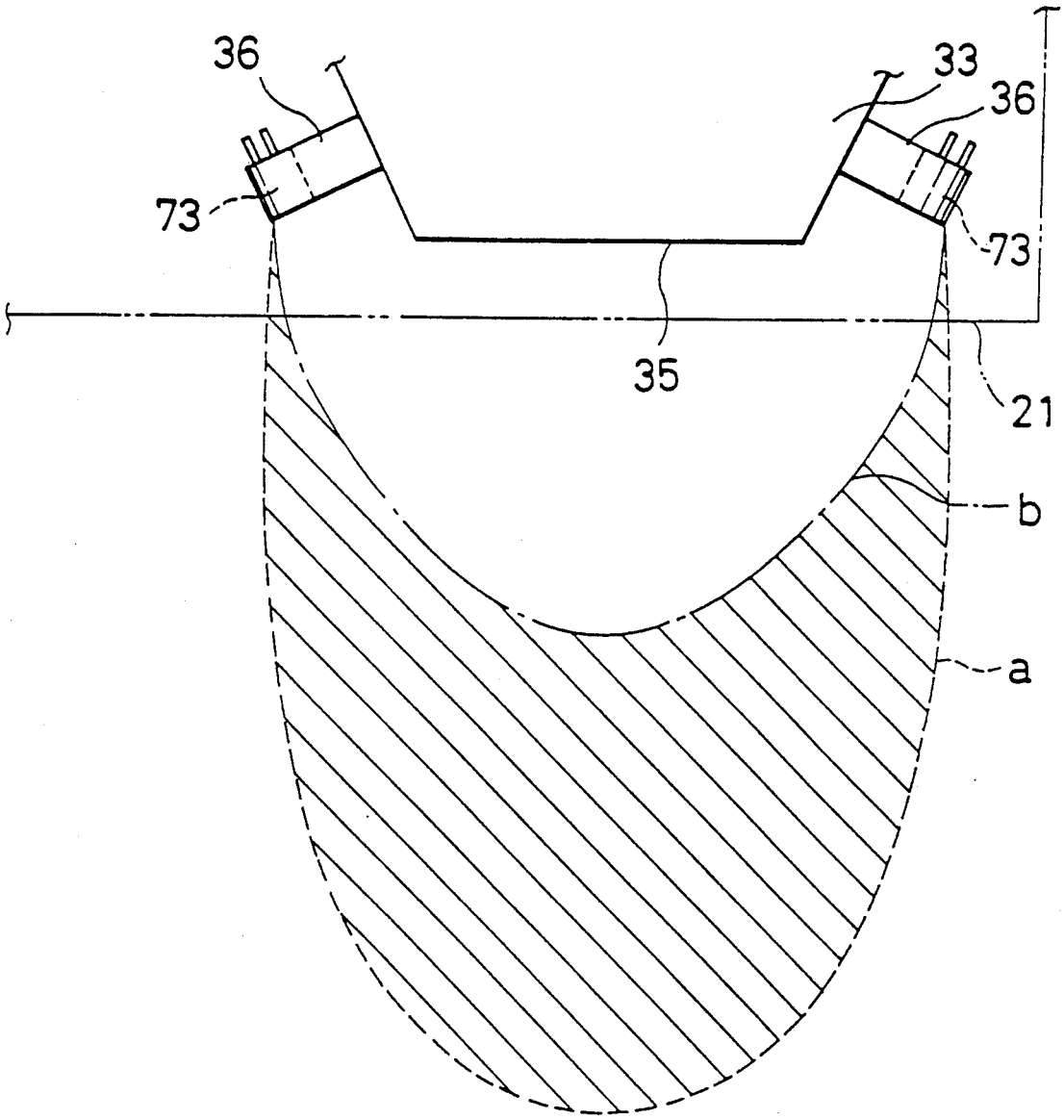
FIG. 3 is a schematic view showing detecting ranges of a sensor section in the control circuit.

FIG. 3 shows detecting ranges of the sensor section 72.

The sensor section 72 comprises a pair of ultrasonic sensors 73 for transmission and reception, which are attached to the left and right side walls of the lower duct 33 through the respective mounting members 36, as also shown in FIG. 3. When an object to be detected (which may be considered to be the user's hand, a part of the user's body other than his or her hands, or an object which can reflect an ultrasonic wave; however, in many cases, the object of detection is the user's hand, and it will therefore be referred to as "the user's hand", hereinafter) is present within a detecting range, the ultrasonic waves that are transmitted on the basis of the electric signal from the oscillator circuit 71 are reflected from the user's hand. When receiving the reflected waves, the ultrasonic sensors 73 convert them into current signals and send these signals to the current-to-voltage converter circuit 74.

The current-to-voltage converter circuit 74 converts the current signals sent from the ultrasonic sensors 73 into a voltage signal.

The amplifier circuit 75 amplifies the low-frequency (from 2 to 20 Hz) signal component of the voltage signal sent from the current-to-voltage converter circuit 74 and sends the amplified signal to both the first and second comparator circuits 76 and 77.

The first comparator circuit 76 compares the amplified voltage sent from the amplifier circuit 75 with a preset low reference voltage (Va). The low reference voltage is equal to a voltage that is sent to the first comparator circuit 76 when the user's hand (i.e., a first object of detection) is detected within a first detecting range (the range surrounded with the chain line in FIG. 3) a which has a relatively large detecting range. When the amplified voltage reaches the low reference voltage, the first comparator circuit 76 sends an intermittent "on" signal to the first timer circuit 66. Conversely, when the amplified voltage is short of the low reference voltage, the first comparator circuit 76 sends an "off" signal to the first timer circuit 66.

The second comparator circuit 77 compares the amplified voltage sent from the amplifier circuit 75 with a preset high reference voltage (Vb). The high reference voltage is set so as to be equal to the voltage that is sent to the second comparator circuit 77 when the user's hand (i.e., a second object of detection) is detected within a second detecting range (the range surrounded with the one-dot chain line in FIG. 3) b which has a relatively small detecting range, the high reference voltage being higher than the low reference voltage. When the amplified voltage reaches the high reference voltage, the second comparator circuit 77 sends an intermittent "on" signal to the second timer circuit 67. Conversely, when the amplified voltage is short of the high reference voltage, the second comparator circuit 77 sends an intermittent "off" signal to the second timer circuit 67.

The first timer circuit 66 initially sets the count to 0 every time an intermittent "on" signal is sent from the first comparator circuit 76 of the detector 7. In addition, the first timer circuit 66 outputs a continuous "on" signal to the heater transistor 62*a* for a predetermined time (e.g., from 1 to 3 seconds) from the moment it starts counting. Conversely, when an "off" signal is sent from the first comparator circuit 76, the first timer circuit 66 outputs an "off" signal to the heater transistor 62*a*.

The second timer circuit 67 initially sets the count to 0 every time an intermittent "on" signal is sent from the second comparator circuit 77 of the detector 7. In addition, the second timer circuit 67 outputs a continuous "on" signal to the fan transistor 63*a* in the fan switching circuit 63 for a predetermined time (e.g., from 1 to 3 seconds) from the moment it starts counting. Conversely, when an "off" signal is sent from the second comparator circuit 77, the second timer circuit 67 outputs an "off" signal to the fan transistor 63*a*.

Figure 4:
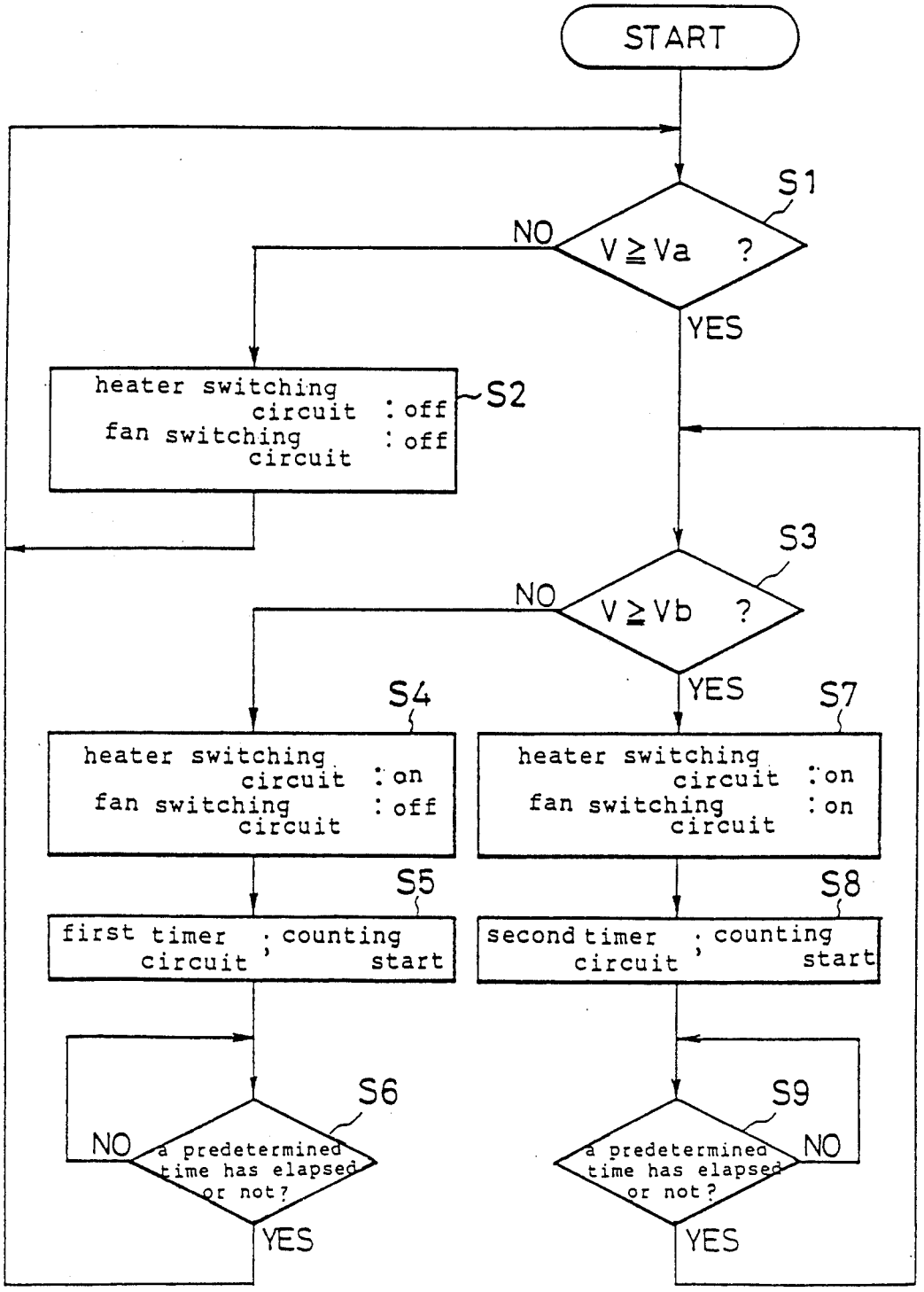
FIG. 4 is an operation flow chart showing the energization control operation of the control circuit.

FIG. 4 is an operation flow chart showing the energizing control operation of the control circuit 6. This operation flow chart is executed only when the main switch 65 is turned on and the control circuit 6 and the commercial power supply are electrically connected together.

It is judged whether or not the user's hand is detected within the first detecting range a that has a relatively large range. In other words, it is judged whether or not the amplified voltage (V) has reached the preset low reference voltage (Va) (i.e., $V \geqq Va$) (Step S1). If the amplified voltage has not yet reached the low reference voltage (i.e., No), the control circuit 6 outputs an "off" signal to both the heater switching circuit 62 and the fan switching circuit 63 (Step S2). Thereafter, the control circuit 6 repeats the control that is executed in Step S1 and Steps subsequent thereto.

When it is judged in Step S1 that the amplified voltage has reached the low reference voltage (i.e., Yes), it is then judged whether or not the user's hand is detected within the second detecting range b that has a relatively small range. In other words, it is judged whether or not the amplified voltage (V) has reached the preset high reference voltage (Vb) (i.e., $V \geqq Vb$) (Step S3).

If the amplified voltage has not yet reached the high reference voltage (i.e., No), the control circuit 6 outputs an "on" signal to the heater switching circuit 62 and an "off" signal to the fan switching circuit 63 (Step S4).

Then, after initially setting the count to 0, the first timer circuit 66 starts counting (Step S5). It is then judged whether or not a predetermined time has elapsed after the starting of the counting (Step S6). If the predetermined time has not yet elapsed (i.e., No), the control that is executed in Step S6 is repeated until the predetermined time has elapsed after the starting of the counting. When the predetermined time has elapsed after the starting of the counting (i.e., Yes), the control that is executed in Step S1 and Steps subsequent thereto is repeated after the completion of the counting.

When it is judged in Step S3 that the amplified voltage has reached the high reference voltage (i.e., Yes), the control circuit 6 outputs an "on" signal to both the heater switching circuit 62 and the fan switching circuit 63 (Step S7).

Then, after initially setting the count to 0, the second timer circuit 67 starts counting (Step S8). It is then judged whether or not a predetermined time has elapsed after the starting of the counting (Step S9). If the predetermined time has not yet elapsed (i.e., No), the control that is executed in Step S9 is repeated until the predetermined time has elapsed after the starting of the counting. When the predetermined time has elapsed after the starting of the counting (i.e., Yes), the control that is executed in Step S3 and Steps subsequent thereto is repeated after the completion of the counting.

The operation of the hand drier control apparatus 1 in this embodiment will be explained on the basis of FIGS. 1 to 3.

This operation is conducted only when the control circuit 6 is connected to the commercial power supply.

When the main switch 65 is turned on, an electric signal of 40.5 kHz is sent from the oscillator circuit 71 to both the ultrasonic sensors 73 of the sensor section 72, and ultrasonic waves are transmitted from the ultrasonic sensors 73 in respective directions which are substantially parallel to the direction of opening of the air outlet 35 (i.e., the downward direction).

I. When the user's hand is not present in either of the first and second detecting ranges a and b:

The ultrasonic waves that are transmitted from the two ultrasonic sensors 73 are reflected from an object (e.g., the floor of the washroom) that is present outside the first detecting range a, and the sensors 73 receive the reflected waves. The reflected waves that are received by the two ultrasonic sensors 73 are converted into current signals therein and intermittently sent to the current-to-voltage converter circuit 74. The current signals that are sent to the current-to-voltage circuit 74 are converted into a voltage signal therein, and the low-frequency signal is amplified in the amplifier circuit 75 and then sent to both the first and second comparator circuits 76 and 77.

The amplified voltage (V0) that is sent from the amplifier circuit 75 is compared with the preset low reference voltage (Va) in the first comparator circuit 76.

However, since the amplified voltage ($V_0$) is short of the low reference voltage (Va) (i.e., $V_0 < Va$), the first comparator circuit 76 sends an "off" signal to the first timer circuit 66. At this time, the first timer circuit 66 outputs an "off" signal to the heater transistor 62*a* in the heater switching circuit 62. In consequence, the heater triac 62*b* is not energized, and the PTC heater 5 is off.

In the second comparator circuit 77 also, the amplified voltage ($V_0$) is short of the high reference voltage (Vb) (i.e., $V_0 < Vb$), and the second comparator circuit 77 therefore sends an "off" signal to the second timer circuit 67. At this time, the second timer circuit 67 outputs an "off" signal to the fan transistor 63*a* in the fan switching circuit 63. In consequence, the fan triac 63*b* is not energized, and the motor 42 of the electric fan 4 is off.

II. When the user's hand enters the hatched portion within the first detecting range a (FIG. 3):

If the user's hand is present in the hatched portion within the first detecting range a (FIG. 3), the ultrasonic waves that are transmitted from the two ultrasonic sensors 73 are reflected from the user's hand. The reflected waves are converted into current signals in the ultrasonic sensors 73 and then intermittently sent to the current-to-voltage converter circuit 74 where the current signals are converted into a voltage signal. The low-frequency signal is amplified in the amplifier circuit 75 and then sent to both the first and second comparator circuits 76 and 77.

In the first comparator circuit 76, the amplified voltage ($V_1$) that is sent from the amplifier circuit 75 is compared with the preset low reference voltage (Va). Since the amplified voltage ($V_1$) has reached the low reference voltage (Va) (i.e., $V_1 \geqq Va$), the first comparator circuit 76 sends an intermittent "on" signal to the first timer circuit 66. In the second comparator circuit 77, on the other hand, the amplified voltage ($V_1$) is short of the high reference voltage (Vb) (i.e., $V_1 < Vb$), and the second comparator circuit 77 sends an "off" signal to the second timer circuit 67. In consequence, the motor 42 of the electric fan 4 is off, as stated above.

The first timer circuit 66 initially sets the count to 0 and starts counting every time an intermittent "on" signal is sent from the first comparator circuit 76. The first timer circuit 66 outputs a continuous "on" signal to the heater transistor 62*a* for a predetermined time (e.g., from 1 to 3 seconds) from the moment it starts counting.

The heater transistor 62*a* energizes the heater triac 62*b* when an "on" signal is sent from the first timer circuit 66, thereby electrically connecting together the PTC heater 5 and the commercial power supply. Thus, the PTC heater 5 that is turned on heats up quickly to a set temperature. On the other hand, the motor 42 of the electric fan 4 is still off, so that the fan member 41 is not driven. Accordingly, no air is blown from the air outlet 35 of the ventilating duct 3.

III. When the user's hand enters the second detecting range b:

When the user's hand, which is brought close to the air outlet 35 of the ventilating duct 3, enters the second detecting range b, the ultrasonic waves that are transmitted from the two ultrasonic sensors 73 are reflected from the user's hand. The reflected waves are converted into current signals in the ultrasonic sensors 73, and these current signals are intermittently sent to the current-to-voltage circuit 74 where they are converted into a voltage signal. The low-frequency signal is amplified in the amplifier circuit 75, and the amplified signal is then sent to both the first and second comparator circuits 76 and 77.

The amplified voltage ($V_2$) that is sent from the amplifier circuit 75 is compared with the preset low reference voltage (Va) in the first comparator circuit 76. Since the amplified voltage ($V_2$) is higher than the low reference voltage (Va) (i.e., $V_2 > Va$), the first comparator circuit 76 sends an intermittent "on" signal to the first timer circuit 66. Since the control of the PTC heater 5 that is conducted thereafter is the same as the operation described above, description thereof is omitted.

In the second comparator circuit 77, the amplified voltage ($V_2$) that is sent from the amplifier circuit 75 is compared with the preset high reference voltage (Vb). Since the amplified voltage ($V_2$) has reached the high reference voltage (Vb) (i.e., $V_2 \geqq Vb$), the second comparator circuit 77 sends an intermittent "on" signal to the second timer circuit 67.

The second timer circuit 67 initially sets the count to 0 and starts counting every time an intermittent "on" signal is sent from the second comparator circuit 77. The second timer circuit 67 outputs a continuous "on" signal to the fan transistor 63*a* for a predetermined time (e.g., from 1 to 3 seconds) from the moment it starts counting.

When an "on" signal is sent from the second timer circuit 67, the fan transistor 63*a* energizes the fan triac 63*b*, thereby electrically connecting together the motor 42 of the electric fan 4 and the commercial power supply. In consequence, the fan member 41 is rotated at a predetermined speed by the motor 42, thus producing a current of air inside the ventilating duct 3. Meantime, the PTC heater 5 has already heated up to a set temperature and therefore heats the air passing therethrough to a predetermined temperature.

Accordingly, the hand drier control apparatus 1 of this embodiment is capable of blowing warm air, which has already been heated satisfactorily, toward the user's hand at the same time as the user brings his or her hands close to the air outlet 35 of the ventilating duct 3 to dry them.

Thus, the present invention is capable of preventing the occurrence of problems which have heretofore been experienced with the conventional apparatus, i.e., the problem that cold air is blown against the user's hand, and the problem that warm air is blown toward the user's hand with a delay corresponding to the set delay time. It is therefore possible to improve remarkably the serviceability of the hand drier.

In addition, since the preheating control that the PTC heater 5 is constantly energized for preheating, even when no hand is detected, is not conducted, it is possible to prevent consumption of excessive electric power as in the case of the preheating control and it is also possible to prevent occurrence of adverse effects on other parts, e.g., undesired heating, which would otherwise be caused by the preheating of the PTC heater 5.

Figure 5:
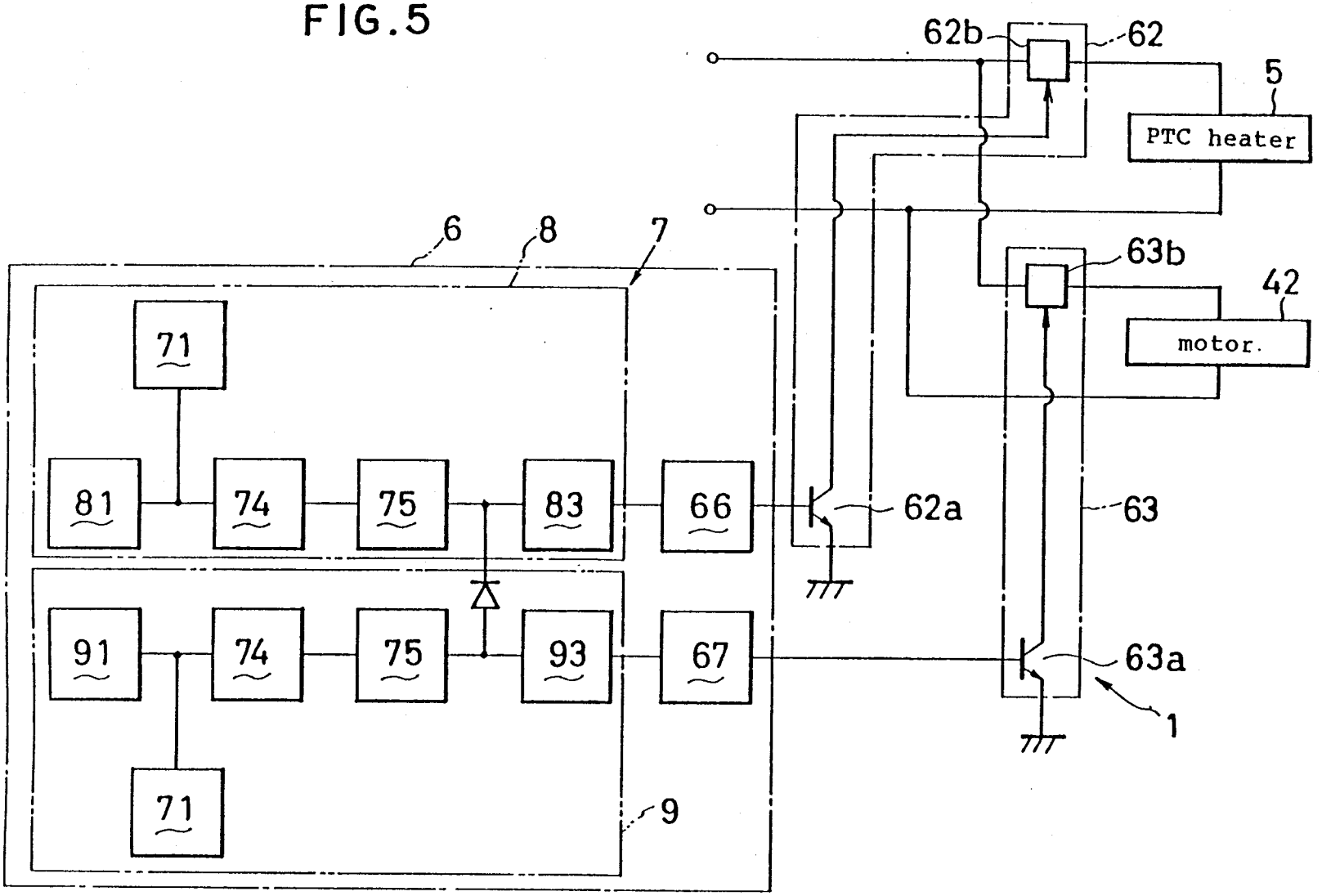
FIG. 5 is a circuit diagram of a control circuit of a hand drier control apparatus that adopts a first embodiment of the present invention.
Figure 6:
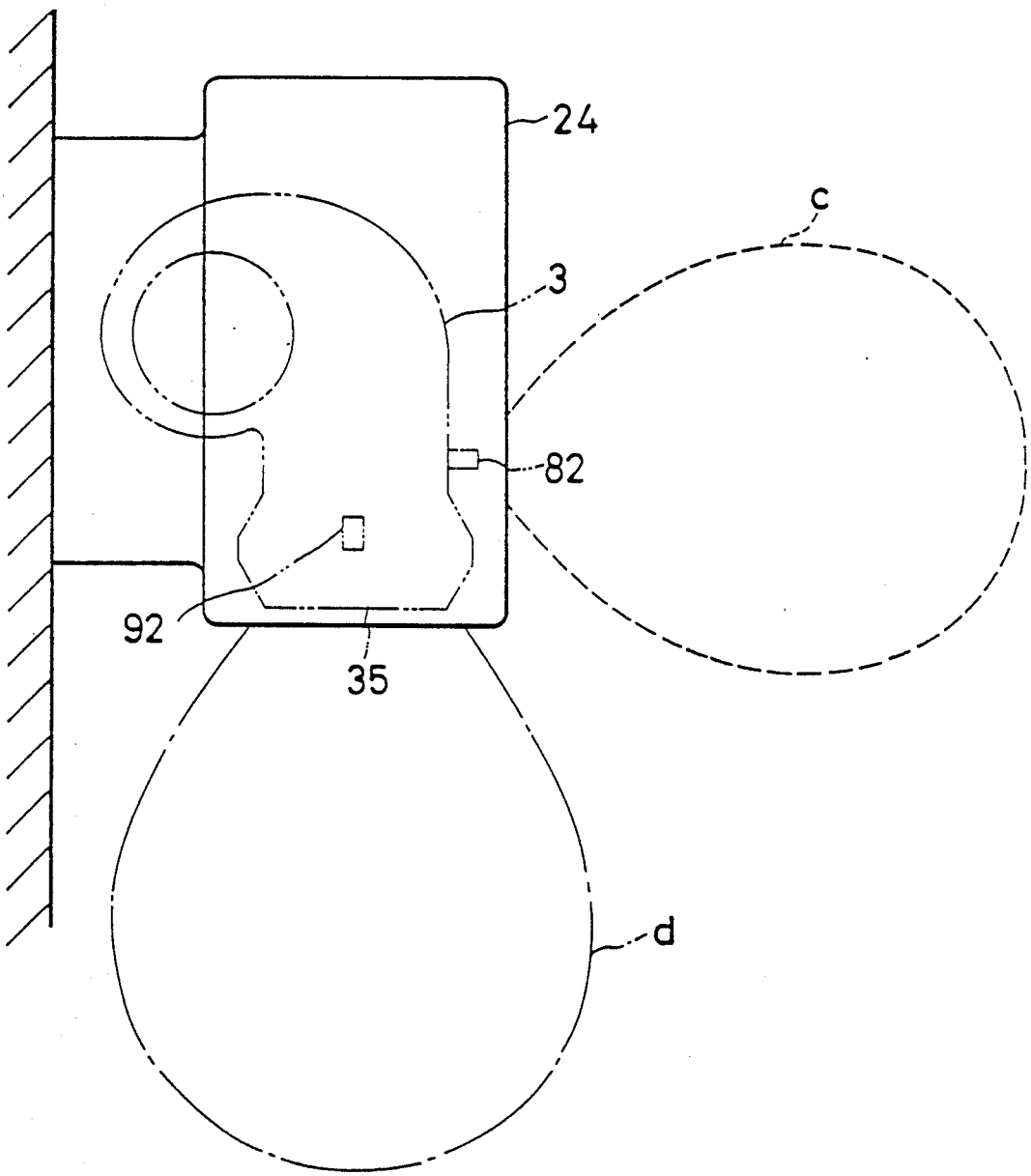
FIG. 6 is a schematic view showing detecting ranges of a sensor section in the control circuit.
Figure 7:
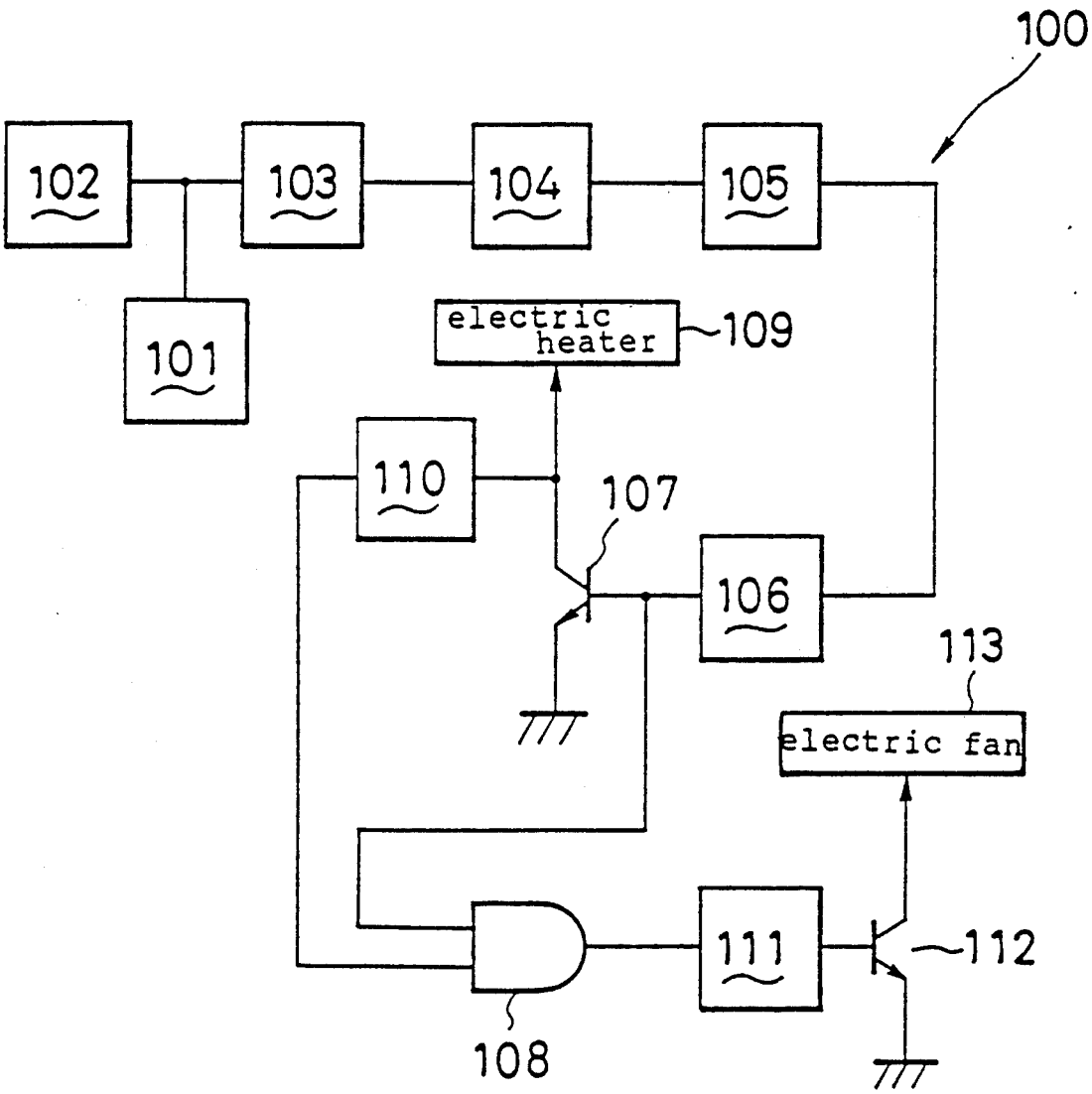
FIG. 7 is a circuit diagram showing a conventional hand drier control apparatus.

FIGS. 5 and 6 show a second embodiment of the present invention. In the second embodiment, elements or portions which have the same functions as those in the first embodiment are denoted by the same reference numerals.

The detector 7 in this embodiment comprises a first detector 8 and a second detector 9.

The first detector 8 comprises an oscillator circuit 71, a first sensor section 81, a current-to-voltage converter circuit 74, an amplifier circuit 75 and a first comparator circuit 83.

The first sensor section 8 comprises an ultrasonic sensor 82 for transmission and reception that is attached to the ventilating duct 3. When the user's body as being an object of detection is present within a detecting range which is in front of the hand drier body 24, the first sensor section 8 sends a current signal to the current-to-voltage converter circuit 74.

The first comparator circuit 83 compares the amplified voltage that is sent from the amplifier circuit 75 with a preset reference voltage (Vc). The reference voltage is equal to a voltage that is sent to the first comparator circuit 83 when the user's body (i.e., a first object of detection) is detected within a first detecting range (the range surrounded with the chain line in FIG. 6) c which is in front of the hand drier body 24. Thus, when the amplified voltage reaches the reference voltage, that is, when the user's body (the first object of detection) is detected, the first comparator circuit 83 sends an intermittent "on" signal to the first timer circuit 66. Conversely, when the amplified voltage is short of the reference voltage, that is, when no user's body (first object of detection) is detected, the first comparator circuit 83 sends an "off" signal to the first timer circuit 66.

The second detecting means 9 comprises an oscillator circuit 71, a sensor section 91, a current-to-voltage converter circuit 74, an amplifier circuit 75, a second comparator circuit 93 and a diode 94.

The second sensor section 91 comprises an ultrasonic sensor 92 for transmission and reception that is attached to the ventilating duct 3. When the user's hand as being an object of detection is present within a detecting range which is in the direction of opening of the air outlet 35 of the ventilating duct 3 (i.e., at the lower side of the hand drier body 24 as viewed in FIG. 6), the second sensor section 91 sends a current signal to the current-to-voltage converter circuit 74.

The second comparator circuit 93 compares the amplified voltage that is sent from the amplifier circuit 75 with a preset reference voltage (Vd). The reference voltage is equal to a voltage that is sent to the second comparator circuit 93 when the user's hand (i.e., a second object of detection) is detected within a second detecting range (the range surrounded with the one-dot chain line in FIG. 6) d which is in the direction of opening of the air outlet 35 of the ventilating duct 3. Thus, when the amplified voltage reaches the reference voltage, that is, when the user's hand (the second object of detection) is detected, the second comparator circuit 93 sends an intermittent "on" signal to both the first timer circuit 66 and the second timer circuit 67. Conversely, when the amplified voltage is short of the reference voltage, that is, when no user's hand (second object of detection) is detected, the second comparator circuit 93 sends an "off" signal to both the first timer circuit 66 and the second timer circuit 67.

The reference voltages (Vc) and (Vd) may be either the same or different. In addition, even if an "off" signal is inputted to the first timer circuit 66 from the second comparator circuit 93 through the diode 94, the first timer circuit 66 outputs an "on" signal to the heater transistor 62*a* as long as an intermittent "on" signal is inputted thereto from the first comparator circuit 83.

Although in the foregoing embodiments the warm-air machine control apparatus of the present invention is applied to a hand drier control apparatus, the present invention may also be applied to other control apparatuses, i.e., controllers for warm-air drying machines other than hand driers, for example, hair driers, controllers for warm-air drying machines, for example, air curtains that are disposed at doorways of factories or buses, and controllers for warm-air heating machines, for example, foot heaters in kitchens or toilets and electric heating appliances for indoor heating.

Although in the foregoing embodiments a centrifugal blower is comprised of an electric fan and a scroll casing, other types of electric fan, for example, an axial fan, may be employed, and any other type of electric fan may also be employed as long as the electric fan employed is capable of producing a current of air inside the ventilating duct.

Although in the foregoing embodiments a pair of ultrasonic sensors for transmission and reception are employed to constitute a sensor section, a sensor in which a a transmission section and a reception section are arranged separately may also be employed. It is also possible to employ a non-contact switch, for example, a pyroelectric sensor, photoelectric sensor, etc. In addition, the sensor section does not necessarily need to be integral with the hand drier body, for example, the ventilating duct. The sensor section may be provided, for example, on the door of a toilet, or a faucet on a washstand.

Although in the foregoing embodiments the detecting means comprises an oscillator circuit, a sensor section, a current-to-voltage converter circuit, an amplifier circuit, a first comparator circuit and a second comparator circuit, it may be constituted of a low-voltage detecting circuit comprising at least a first sensor section and a first comparator circuit, and a high-voltage detecting circuit comprising at least a second sensor section and a second comparator circuit. The detecting means may also be arranged in the form of a current detecting circuit, a temperature detecting circuit, or a luminous intensity detecting circuit. In short, it is possible to utilize any non-contact type detecting means as long as the detecting means employed has a predetermined detecting range, for example, a two-dimensional range, a three-dimensional range, etc.

Although in the first embodiment the first and second objects of detection are the same object, for example, the user's hand, the first and second objects of detection may be different from each other as in the second embodiment. For example, in the case of a hair drier control apparatus, the user's hand may be detected as a first object of detection and the user's head may be detected as a second object of detection.

Although in the foregoing embodiments a combination of a transistor and a triac is employed as a switching circuit, it is also possible to employ a relay, an ON/OFF switch, etc. as a switching circuit.

Although in the foregoing embodiments the air that passes through a ventilating duct is heated by a PTC heater, the air that is sent toward the user's body by an electric fan may be heated by an electric heater, for example, a PTC heater, without providing a ventilating duct.

INDUSTRIAL APPLICABILIY

According to the warm-air machine control apparatus of the present invention, it is unnecessary to adopt the electric heater preheating control and it is therefore possible to prevent consumption of excessive electric power and avoid adverse effects on other parts. As soon as an object of detection is detected by a non-contact detecting mean, sufficiently heated air can be blown toward the user's body, that is, warm air can be supplied immediately and from the beginning. It is therefore possible to improve remarkably the serviceability of the warm-air machine.

What is claimed is:

1. A hand drier control apparatus to be mounted on a wall comprising:

a ventilating duct having an outlet for air, an electric fan attached to the ventilating duct for producing a current of air flowing toward a user through the outlet when actuated, an electric heater attached to the ventilating duct for heating air flowing toward the user by the electric fan when actuated, non-contact detecting means for detecting a first object to be detected within a first detecting range and for detecting a second object to be detected within a second detecting range, said first detecting range being located below and relatively close to the outlet, and said second detecting range being located below the outlet and adjacent to the first detecting range, said second detecting range being located away from the outlet more than the first detecting range, and a control circuit for actuating the electric heater when the detecting means detects the first object within the first detecting range, and actuating the electric fan when the detecting means detects the second object within the second detecting range.

2. The apparatus of claim 1, wherein each of said first and second objects of detection is a part of the user.

* * * * *